US008266831B2

(12) United States Patent
Louie

(10) Patent No.: US 8,266,831 B2
(45) Date of Patent: Sep. 18, 2012

(54) PROMOTIONAL MULTI-YEAR ROTATIONAL CALENDAR

(76) Inventor: Chee Wing Louie, Oakland, CA (US)

( * ) Notice: Subject to any disclaimer, the term of this patent is extended or adjusted under 35 U.S.C. 154(b) by 208 days.

(21) Appl. No.: 12/924,273

(22) Filed: Sep. 24, 2010

(65) Prior Publication Data

US 2012/0073167 A1 Mar. 29, 2012

(51) Int. Cl.
*G09D 3/08* (2006.01)

(52) U.S. Cl. ..... 40/113; 40/121; 368/37

(58) Field of Classification Search ..... 40/107–120
See application file for complete search history.

(56) References Cited

U.S. PATENT DOCUMENTS 1,426,982 A * 8/1922 Grunewald ..... 40/113
1,495,158 A * 5/1924 Burnham ..... 40/113
1,507,345 A * 9/1924 Doyle ..... 40/121
2,191,757 A * 2/1940 Hacker ..... 40/113
2,292,697 A * 8/1942 Juergens ..... 281/17
2,462,598 A * 2/1949 Blodget ..... 40/113
2,537,693 A * 1/1951 Nono ..... 40/113
2,932,104 A * 4/1960 Corbett ..... 40/113
4,041,628 A 8/1977 Sasson
4,285,148 A 8/1981 Kolar
4,308,678 A 1/1982 Slobin
4,541,725 A 9/1985 Baumgartner et al.
5,124,013 A * 6/1992 Seddon et al. ..... 204/192.12
5,313,723 A 5/1994 Cregg
6,160,766 A 12/2000 Chiang
6,964,512 B2 11/2005 Brophy
7,363,735 B2 4/2008 Riddle
2005/0120598 A1* 6/2005 Bury ..... 40/119
2009/0139121 A1* 6/2009 Bury ..... 40/121

* cited by examiner

*Primary Examiner* — Lesley D Morris
*Assistant Examiner* — Shin Kim
(74) *Attorney, Agent, or Firm* — Daniel R. Richardson

(57) ABSTRACT

There is a felt need on the part of business people to have an affordable individualized promotional piece similar to and about the size of a standard business card that will have some inherent practical value to the recipient of the piece that induces the recipient to keep and to use the practical feature of the piece. The present invention provides a multi-year calendar not much bigger than a standard business card which encourages the recipient to keep and use the invention as a calendar for possibly several years, with the business person's name and contact information pre-printed on the invention. The calendar uses a coded wheel and the edge of the table area to get the correct code which then acts as a key to reveal the days and dates for the entire month on the inner semi-circles.

3 Claims, 3 Drawing Sheets

| Date | 31 | 29 | 31 | 30 | 31 | 30 | 31 | 31 | 30 | 31 | 30 | 31 |
|---|---|---|---|---|---|---|---|---|---|---|---|---|
| Month | JAN | FEB | MAR | APR | MAY | JUN | JUL | AUG | SEP | OCT | NOV | DEC |
| 2008 | T | F | S | T | T | S | T | F | M | W | S | M |

| Date | 31 | 28 | 31 | 30 | 31 | 30 | 31 | 31 | 30 | 31 | 30 | 31 |
|---|---|---|---|---|---|---|---|---|---|---|---|---|
| Month | JAN | FEB | MAR | APR | MAY | JUN | JUL | AUG | SEP | OCT | NOV | DEC |
| 2009 | T | S | S | W | F | M | W | S | T | T | S | T |
| 2010 | M | T | M | T | S | T | T | S | W | F | M | W |
| 2011 | S | T | T | F | S | W | F | M | T | S | T | T |

| Date | 31 | 29 | 31 | 30 | 31 | 30 | 31 | 31 | 30 | 31 | 30 | 31 |
|---|---|---|---|---|---|---|---|---|---|---|---|---|
| Month | JAN | FEB | MAR | APR | MAY | JUN | JUL | AUG | SEP | OCT | NOV | DEC |
| 2012 | S | W | T | S | T | F | S | W | S | M | T | S |

PROMOTIONAL MULTI-YEAR ROTATIONAL CALENDAR

CROSS-REFERENCE TO RELATED APPLICATIONS

None

STATEMENT REGARDING FEDERALLY SPONSORED RESEARCH

None

THE NAMES OF THE PARTIES TO A JOINT RESEARCH AGREEMENT

None

INCORPORATION-BY-REFERENCE OF MATERIAL SUBMITTED ON A COMPACT DISC

None

BACKGROUND OF THE INVENTION (1) Field of the Invention

The present invention relates to the field of calendars, in particular multi-year calendars. The invention also relates to individualized promotional material for use by a person who desires to promote his name or the name of his business along with contact information.

(2) Description of Related Art including information disclosed under 37 CFR 1.97 and 1.98

U.S. Pat. No. 4,285,148, "Universal Round Clock Calendar", issued to Karel Kolar, on Aug. 25, 1981, discloses a universal round calendar which may be employed for various calendar systems. The calendar, according to the invention, consists of two mutually revolving discs carrying indication marks for calendar data. This patent is primarily for use as the face of a wristwatch and does not accommodate multiple years.

U.S. Pat. No. 4,308,678, "Two-Date Reminder", issued to Joel B. Slobin, on Jan. 5, 1982, discloses a visible reminder of two dates which the user selects by rotatably adjusting at least one pair of concentric discs carrying inner and outer circular date scales which cooperate with corresponding reference marks to designate the selected dates. This patent is primarily for reminding the user of two important dates after being set. However, it does not have a multi-year capability.

U.S. Pat. No. 5,313,723, "Perpetual Calendar", issued to Scott A. Cregg, on May 24, 1994, discloses a calendar including a first disk and a second disk. The second disk is connected to and rotatable concentrically relative to the first disk. The first disk includes a window representing the various days of the week. The first disk further includes indicia indicating various months of the year and lead lines which function as pointers.

U.S. Pat. No. 6,964,512, "Personal Organization Tool", issued to A. Daniel Brophy, on Nov. 15, 2005, discloses a personal organizational tool comprising an indicator and an analog display divided into areas representing days of the week to help people organize themselves and remind them of various events or activities.

BRIEF SUMMARY OF THE INVENTION

There is a felt need on the part of business people to have an affordable individualized promotional piece similar to a standard business card that will have some inherent practical value to the recipient of the piece that induces the recipient to keep and to use the practical feature of the piece. The present invention provides a multi-year calendar not much bigger than a standard business card which encourages the recipient to keep and use the invention as a calendar for possibly several years, with the business person's name and contact information pre-printed on the invention. The calendar uses a coded wheel and the edge of the table area to get the correct code which then acts as a key to reveal the day and date for the entire month.

BRIEF DESCRIPTION OF THE SEVERAL VIEWS OF THE DRAWING(S)

DETAILED DESCRIPTION OF THE INVENTION

Figure 1:
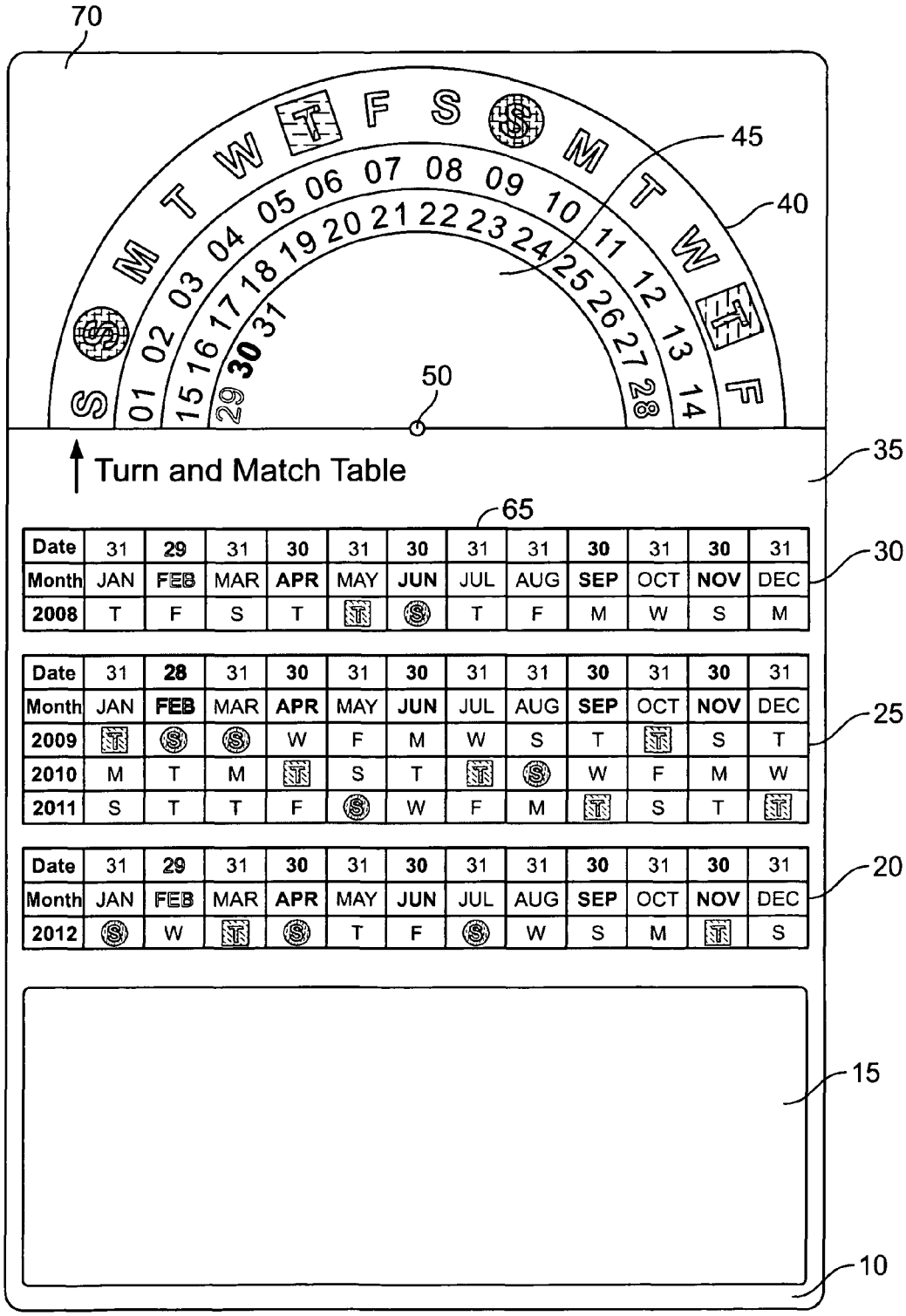
FIG. 1 is a vertical placement of the elements of the invention

The following reference numerals are used to describe the drawings:

10 promotional multi-year rotational calendar is the invention disclosed herein

15 promotional area for pre-printing the promotional information for the particular piece, e.g. name, address, phone number, website, etc.

20 future single year calendar area displays the codes necessary for use as a "key" to get the day/date for the indicated year

25 multiple year calendar area displays the codes necessary for use as a "key" to get the day/date for each of the indicated years

30 starting single year calendar area displays the codes necessary for use as a "key" to get the day/date for the starting year for the calendar, which would typically be the "current" year when the promotional multi-year rotational calendar 10 is given to someone

35 instruction area has the pre-printed single instruction "Turn and Match Table" with an arrow pointing to the leading edge of the instruction area 35 adjacent to the rotatable outer wheel 40 of the invention 10. The instructional area 35 is shown with the instruction in the English language, but the invention 10 can also be printed in any desired alternative language with the appropriate language symbols.

40 rotatable outer wheel is a wheel with pre-printed codes on it, and used to match the code on the appropriate year and month for the desired day/date look-up.

45 fixed inner wheel is a fixed portion of the invention 10, with grouping of concentric semi-circular wheels with pre-printed dates for the month distributed 1-14 in the outermost semi-circular portion of the fixed inner wheel 45, 15-28 for the center portion and 29-31 starting on the left and inside the innermost semi-circle or center portion

50 round grommet for affixing the center of the rotatable outer wheel 40 to the invention 10 such that the rotatable outer wheel 40 is able to be rotated freely in either direction

55 weekday letter is the repeated sequence of the first letter for each day of the week, disposed in repeating sequence equally about the rotatable outer wheel 40, and including certain special encoded day letters 60, as the text in the instruction area 35 states, the letter on the rotatable outer wheel must be matched with the desired year month 65 and the corresponding either weekday letter 55 or a special encoded day letter 60 must be matched to the day letter code for the desired month and year in one of the calendar areas (30, 25 or 20).

60 special encoded day letter is one of the first letters for a day of the week, i.e. S,S,M,T,W,T,F, but in order to get the correct weekday letter 55 or special encoded day letter 60, certain of the single letters are surrounded with either a circle or with a square, there may also be a color associated with the letter for quick reference, to make such letters special encoded day letters 60. The preferred embodiment of the invention 10, uses color in the squares and circles to make it even easier to match the correct day letter.

65 desired year month day table entry is the combination of the number of days in the month, the month abbreviation and the letter to make up a table entry in one of the calendar areas (30, 25 or 20). The day letter will either be a weekday letter 55 or a special encoded day letter 60 for use in matching the same either weekday letter 55 or a special encoded day letter 60 on the rotatable outer wheel 40.

DETAILED OVERVIEW FOR USE OF THE INVENTION

The invention 10 supports a multi-year configuration, with the number of years displayed, limited only by the space on the promotional item 10. In this invention, each individual year will be displayed in a horizontal table element with 12 entries, one table element for each year, starting with JAN on the left and proceeding to DEC on the right, and the year pre-printed to the left of its calendar area (20, 25 or 30).

The preferred embodiment of the invention 10 uses letters for days of the week 55 and numbers for the particular day, and shapes and color with or without shapes for quick visual orientation to calendar elements 60. Thus, all of the 30 day months will be set out with a particular color, for example, green. The month of February, will always be a unique color, different from the 30 days per month color, for example, blue. The remaining 31 day months are usually simply a white background for the black letters, but a contrasting color could also be used here, if desired.

When the month of February has the same number of days for several years, i.e. between leap years, those calendar year table rows (20, 25 or 30) are grouped together. Likewise, when the year has February for a leap year, that year is not grouped with other years, but is simply a single calendar area/table (20 or 30).

The colors used for specially encoded day letters 60 as used on either the rotatable outer wheel 40 or for one of the calendar areas (20, 25 or 30), will always be matched in use, so that they can be used to find the correct day/date.

In an example of use for the preferred embodiment, the rotatable outer wheel 40 is in the color of green, with most of the day letters printed in black, bold print and disposed as S,S,M,T,W,T,F in four repeated sets around the rotatable outer wheel. Each letter S for Sunday is encircled in yellow with the letter S in red. Each T for Thursday is in a purple square with the letter T for Thursday in a darker purple.

The same colors and square/circle configuration is repeated in each year table unit, i.e. the yearly table units are printed with the background color of green, with most of the day letters printed in black, bold print and disposed as S,S, M,T,W,T,F when used. Each letter S for Sunday is encircled in yellow with the letter S in red. Each T for Thursday is in a purple square with the letter T for Thursday in a darker purple. The leap years, 2008 and 2012 are shown with the day number 29 and the FEB with a blue background and black print. The non-leap years, 2009, 2010, 2011 have an orange background for the number 28 and FEB. The 31 day months have white background for the number 31 and the associated month, along with green background for the number 30 for the 30 day months and their associated month.

The fixed inner wheel 45 is featured with a white background for both the outer semi-circles, and a yellow color for the innermost semi-circle. The fixed inner wheel 45 has three concentric semi-circles with the numbered days of the month disposed at the edge of each semi-circle. The outer semi-circle has a white background with black letters for day numbers 1 through 14. The next inside semi-circle has a white background with black letters for day numbers 15 through 28, with the number 28 in red. The innermost semi-circle 45 has the numbers 29, 30 and 31 disposed on the lower left starting at the lower left edge of the inner semi-circle 45, with the numbers 29 and 30 in blue, with the number 31 in black.

In using the invention 10 with this embodiment, let us say we are in the year 2008, and we want the calendar days for the 31 day month of May. We then use the desired year month day table entry 65 for 2008 in the calendar area 30. We find that this day table entry 65 has a purple-boxed letter T. We then turn the rotatable outer wheel 40 to show one of the purple-boxed T letters on the top edge of the instructional area 35, and above the arrowhead for the arrow in the instruction text. With the weekday letter 55 thus aligned, the correct day numbers on the fixed inner wheels 45 are now aligned with the days of the week, and the calendar for the month of May in 2008 is now available to the user.

For purposes of this description, all of the letters and the instructional area 35 is shown with the instruction in the English language, but the invention 10 is not limited to English, and the letters and text can also be printed in any desired alternative language with the appropriate language symbols.

The following is a detailed description of the drawings:

FIG. 1 discloses a vertical placement of the elements of the promotional multi-year rotational calendar 10. The promotional area 15 is shown as the area at the bottom of the other elements of the invention 10, this of course is not a required feature of the invention 10 as the promotional area 15 can be in any position and of a desired size, on the field. Just above the promotional area 15, is the future single year calendar area 20 wherein a single future year, typically the next in sequence after the last year from the adjacent region above, the multiple year calendar area 25. The latter will depict several years, each in ascending sequence starting after the starting single year calendar area 30, which will typically be the current year in which the promotional multi-year calendar 10 is printed and/or distributed. The top area in the field, the instruction area 35, and the area just below the fixed inner wheel 45, has the pre-printed single instruction "Turn and Match Table" with an arrow and the head of the arrow pointing to the top edge of the instruction area 35 and in line with and pointing to the rotatable outer wheel 40. The top edge of the instruction area 35, is the horizontal boundary for the fixed inner wheel 45, it has the round grommet 50 affixed in line with the edge and in the center of the fixed inner wheel 45. The same top edge is also used to get the correct code from the rotatable outer wheel 40 as pointed to by the arrow and arrowhead adjacent to the text in the instruction area 35.

Figure 2:
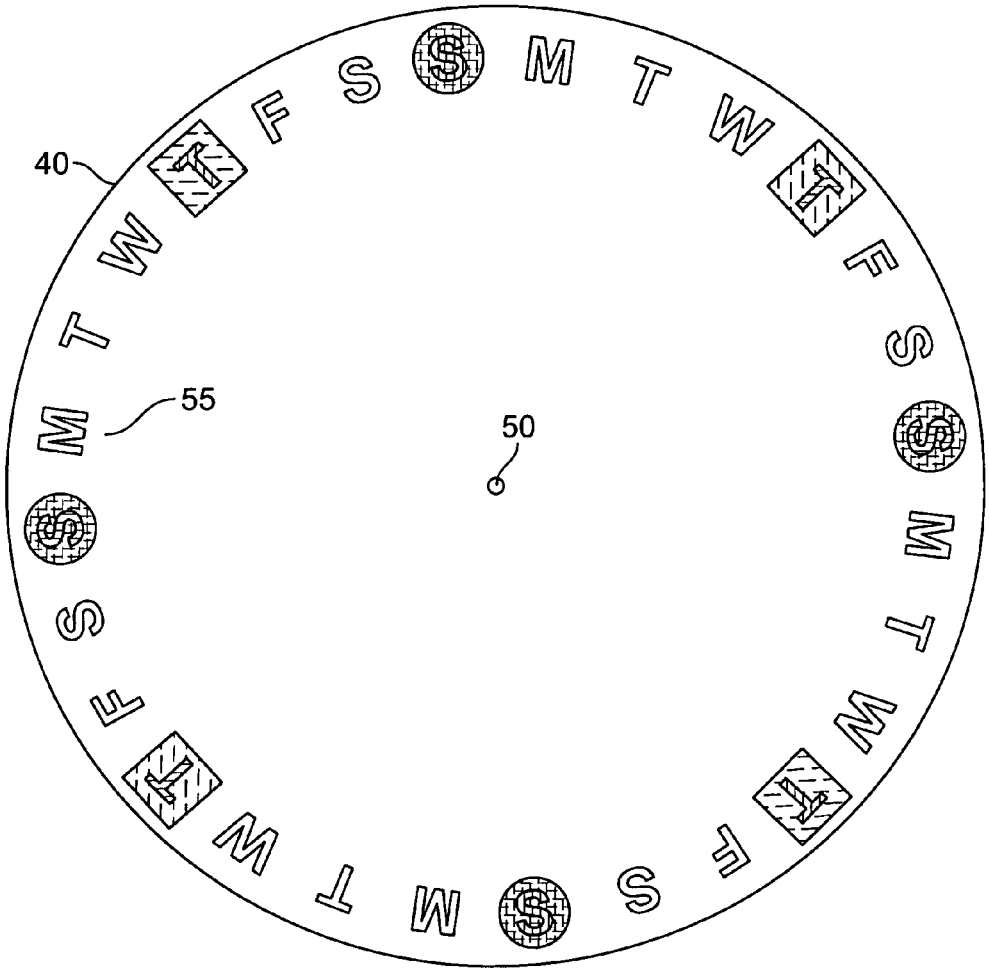
FIG. 2 depicts the circular shaped wheel used to rotate and orient the calendar

FIG. 2 depicts the circular shaped rotatable outer wheel 40 that rotates around the centered round grommet 50 that is used to affix the center of the rotatable outer wheel 40 to the fixed inner wheel 45 (see FIG. 1). When the rotatable outer wheel 40 is turned, there is a single letter that will be exposed on top of the top edge of the instruction area 35 (see FIG. 1) with each movement of the wheel 40. The exposed letter will either be a weekday letter 55 or a special encoded day letter 60 that is used to match with the letter (55 or 60) corresponding with the desired year month day table entry 65 (see FIG. 1). The rotatable outer wheel 40 will typically have a background color to set it off from the typically white background of the first semi-circle of the fixed inner wheel 45. The weekday letters 55 are printed in black, bold print and disposed as S,S,M,T,W,T,F in four repeated sets around the rotatable outer wheel 40. Each letter S for Sunday is specially encoded day letter 60 and will typically be encircled in a color, e.g. yellow, with the letter S in a contrasting color, e.g. red. Each T for Thursday is in a colored square, e.g. purple, with the letter T for Thursday in a darker version of the same color as the containing square.

Figure 3:
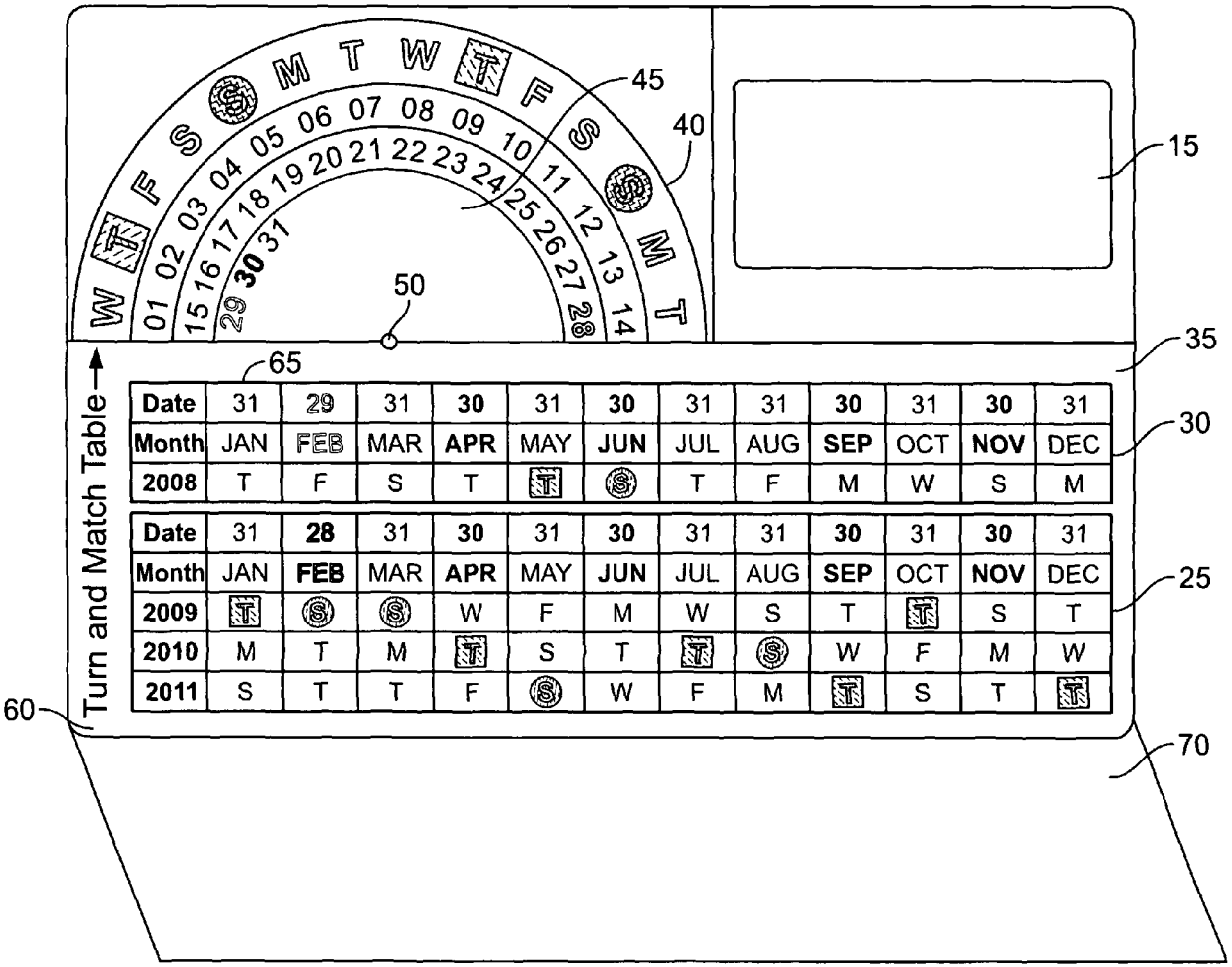
FIG. 3 is a horizontal placement of the elements of the invention

FIG. 3 depicts a horizontal placement of the elements of the invention 10. The horizontal embodiment of the invention 10 is somewhat different from the vertical version as depicted in FIG. 1. The promotional area 15 is in the upper right side of the invention 10. The instruction area 35 still has a top edge running horizontally through the round grommet 50 and with the text now on the left side of the "L" shape of the instruction area 35 with the pre-printed single instruction "Turn and Match Table" with an arrow and the head of the arrow pointing to the top edge of the instruction area 35 and in line with and pointing to the rotatable outer wheel 40. The field of the invention 10 may have a combination of single or multiple year areas (20, 25 or 30). As depicted in this figure, just under the instruction area 35, there is a starting single year calendar area 30 and below that, there is a multiple year calendar area 25. The number of table entries for a calendar year area (20, 25 or 30) will be governed by whether or not the table entry is either for a leap year, with a single entry or several non-leap years grouped together.

SEQUENCE LISTING none

I claim:

1. A promotional multi-year rotational calendar comprising:

A rectangular piece of paper of cardstock weight, comprised of a top portion, a central portion and a bottom portion;

Said rectangular piece of paper having a semi-circle cut out in said top portion, comprising a fixed inner wheel;

Said fixed inner wheel having a grommet fastened in the center of said fixed inner wheel that fastens said fixed inner wheel on top of a concentrically mounted circular piece of cardstock, comprising a rotatable outer wheel, that is larger in diameter than said fixed inner wheel;

Said fixed inner wheel is pre-printed with an outer semi-circular circumference set of numbers beginning with the number 01 and disposed on the outer semi-circular circumference of said fixed inner wheel, continuing in increments of 1 to the number 14;

Said fixed inner wheel is pre-printed with an inner semi-circular circumference set of numbers separated by a semi-circular line just inside said outer semi-circular circumference set of numbers and beginning with the number 15 and continuing in increments of 1 to the number 28;

Said fixed inner wheel is pre-printed with an innermost semi-circular circumference set of numbers separated by a semi-circular line just inside said inner semi-circular circumference set of numbers beginning with the number 29 and continuing in increments of 1 to the number 31;

Said rotatable outer wheel is pre-printed with the first letter for each day of the week, that being the letters S, S, M, T, W, T, F in a repeated series four times with all letters equidistant on the rotatable outer wheel such that they are visible just above the edge of said fixed inner wheel;

Said first letter of each day of the week as disposed on said rotatable outer wheel is color-coded to convey additional information, the letter S for Sunday is red and encircled in yellow, each T for Thursday is in dark purple in a lighter purple square;

Said central portion of said rectangular piece of paper is comprised of two areas, a pre-printed message area and a pre-printed calendar rectangular area;

Said pre-printed message area of said rectangular piece of paper is pre-printed with the text phrase "Turn and Match Table" with said text phrase having an arrow symbol pointed in the direction of said rotatable outer wheel;

Said pre-printed calendar rectangular area of said central portion of said rectangular piece of paper is pre-printed with table groups of rows of text and numbers, each said table group having at least a first top row for the date day, a second row for the month and at least one subsequent table group row for the year;

Said table group first top row for the date day is pre-printed with the word "Date" in the leftmost cell element to identify said table group first top row as the date day row, followed by 12 fixed size cell elements each containing a single number in each said fixed size cell element, said single numbers being the number of days in the month for the first three letters of the abbreviated month as pre-printed immediately below said 12 fixed size cell elements in said table group first top row for the date day;

Said second row for the month is pre-printed with the word "Month" in the leftmost cell element to identify said second row for the month followed by 12 fixed size cell elements each containing the first three letters of the abbreviated month starting with "JAN" and continuing in calendar sequence to "DEC";

Said table group first top row for the date day where said fixed size cell element is 28 for FEB, a non-leap year, both the number of days and the abbreviated month, FEB, in said second row for the month are pre-printed in orange;

Said table group first top row for the date day where said fixed size cell element is 29 for FEB, a leap year, both the number of days and the abbreviated month, FEB, in the at least one subsequent row for the FEB month are pre-printed in green;

Said at least one subsequent table group row for the year is pre-printed with the number of the calendar year in the leftmost cell element to identify said at least one subsequent table group row for the year followed by 12 fixed size cell elements each containing the pre-printed first letter of the day of the week that corresponds with the directly above fixed size cell element for the month and directly above fixed size cell element in the table group first top row for the date day which contains the number for the last day of said day and month; and Said pre-printed first letter of the day of the week are color-coded to match the said first letter of each day of the week as disposed on said rotatable outer wheel, the letter S for Sunday is red and encircled in yellow, each T for Thursday is in dark purple in a lighter purple square.

2. The promotional multi-year rotational calendar of claim 1 wherein said top portion, has a rectangular blank portion, separated from said fixed inner wheel, and from said rotatable outer wheel, comprising a top portion promotional area.

3. A method for finding a day, month and year combination using a promotional multi-year rotational calendar having a rectangular piece of paper of cardstock weight, comprised of a top portion, a central portion and a bottom portion, wherein said top portion comprises a said semi-circle fixed inner wheel and said concentrically affixed rotatable outer wheel, and said central portion of said rectangular piece of paper is comprised of a said pre-printed message area, and a multiplicity of said pre-printed calendar rectangular areas, comprising:

(a) The searcher determines the desired calendar month so as to locate the dates for all days in that month;

(b) The searcher first selects the set of three table cells which are the vertical set of the Date/Month/Year matching the desired calendar month;

(c) The searcher identifies the color of the abbreviated day of the week in the selected set of three table cells and then turns the rotatable outer wheel until the same color abbreviated day of the week is immediately above the "Turn and Match Table" with the arrow pointing to the rotatable outer wheel;

(d) The fixed inner wheel is now aligned with the abbreviated days of the week for each of the days of the desired calendar month, so that the searcher can now read any date of the calendar month on the fixed inner wheel and see the abbreviated day of the week on the rotatable outer wheel;

(e) The searcher repeats the previous steps (a) through (d) for any further desired calendar month.

* * * * *